US006872001B1

(12) United States Patent
Gilevich

(10) Patent No.: US 6,872,001 B1
(45) Date of Patent: Mar. 29, 2005

(54) X-RAY SHIELDING STRUCTURE FOR FOOD INSPECTION STATION

(75) Inventor: Alexander I. Gilevich, Sunnyvale, CA (US)

(73) Assignee: Peco Controls Corp., Fremont, CA (US)

( * ) Notice: Subject to any disclaimer, the term of this patent is extended or adjusted under 35 U.S.C. 154(b) by 0 days.

(21) Appl. No.: 10/428,484

(22) Filed: May 5, 2003

(51) Int. Cl.[7] ..... H05G 1/26
(52) U.S. Cl. ..... 378/208; 378/57; 378/203
(58) Field of Search ..... 378/203, 208, 378/57, 51, 68, 69, 64

(56) References Cited

U.S. PATENT DOCUMENTS 4,020,346 A * 4/1977 Dennis ..... 378/57
4,879,735 A * 11/1989 Owens ..... 378/57
6,430,255 B2 * 8/2002 Fenkart et al. ..... 378/57

* cited by examiner

*Primary Examiner*—Edward J. Glick
*Assistant Examiner*—Hoon Song
(74) *Attorney, Agent, or Firm*—J. E. McTaggart

(57) ABSTRACT

For suppressing extraneous radiation from an x-ray type food inspection station enclosure having an entry tunnel and an exit tunnel, two pairs of swinging shield doors are provided, one pair located in the entry tunnel and one pair located in the exit tunnel. In a preferred embodiment, each door is actuated by a dedicated pneumatic door actuator located above the door and placed under control of a microprocessor system that also controls the entire conveyor and x-ray inspection process, in particular closing the doors in the event of a gap in the series of containers that could otherwise allow excessive x-ray leakage from the tunnel. As a fail-safe measure, the shield doors are configured with a slip clutch drive and a mechanical override system that tends to close the doors to maintain x-ray radiation suppression in the event of failure of a door actuator or power source thereof.

4 Claims, 4 Drawing Sheets

X-RAY SHIELDING STRUCTURE FOR FOOD INSPECTION STATION

FIELD OF THE INVENTION

The present invention relates to the field of x-ray inspection of materials in containers, and more particularly to shielding of x-ray radiation for personnel protection in the sequential x-ray inspection of containers of food and beverages moving along a conveyor.

BACKGROUND OF THE INVENTION

X-rays have been used for inspection purpose for many years especially for the ability to detect impurities with higher density than the substance under test. Despite efforts to focus the x-rays from the generator and confine them to the product item under test and the sensor, x-rays tend to scatter whenever they collide with matter, therefore, in the work environment, workers must be protected from harmful effects of exposure to extraneous x-ray radiation.

In the field of endeavor of the present invention where the product item is typically packaged food and drink items such as bottled liquids moving along a conveyor, it is customary to fully surround the generator, product item under test, sensor and the associated portion of the conveyor with an enclosure constructed with x-ray shielding material, typically of UMW (ultra high molecular weight) to avoided excessive thickness requirements.

In one approach of known practice, the enclosure is configured with a pair of tunnels, one at the entry opening and the other at the exit opening, dimensioned to fit closely around the product containers moving along the conveyor; if the product containers are close-spaced, they tend to fill these tunnels sufficiently to prevent excessive x-ray radiation from escaping through the entry and exit tunnel openings. However in the event that a sizeable gap occurs somehow between the product containers along the conveyor, the increase in x-ray radiation escaping through the tunnels may become excessive and potentially harmful.

DISCUSSION OF KNOWN ART

U.S. Pat. No. 6,430,255 to Fenkart et al discloses a NONINTRUSIVE INSPECTION SYSTEM using x-ray apparatus in which radiation containment is implemented by a system of four shielding curtains that can be raised and lowered quickly to allow entry and exit of the workpiece, in this case baggage, being inspected by x-rays as it moves continuously on a conveyor through a shielded inspection chamber.

OBJECTS OF THE INVENTION

It is a primary object of the present invention to provide a shielding system for entry and exit openings in a shielding enclosure of an x-ray inspection system addressed to materials in containers moving along a conveyor, that will keep x-ray radiation leakage outside the enclosure to an acceptable limit, independent of the inter-spacing of the containers along the conveyor.

It is a further object that any moving parts in the shielding system that are normally actuated via a motive source be made to be automatically fail-safe with regard to radiation shielding in the event of any failure of the motive source.

It is a further object that the shielding system should not introduce any reduction of the normal rate of inspection testing.

SUMMARY OF THE INVENTION

The abovementioned objects have been met by the present invention of two pairs of swinging shield doors, one in the entry tunnel and one in the exit tunnel. In a preferred embodiment, each of these doors is actuated each by a dedicated pneumatic door opening/closing mechanism placed under control of a microprocessor system that also controls the entire x-ray inspection process. The doors are configured with a clutch drive and a mechanical override system that tends to close the doors in the absence of close-spaced product items in that region of the conveyor.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
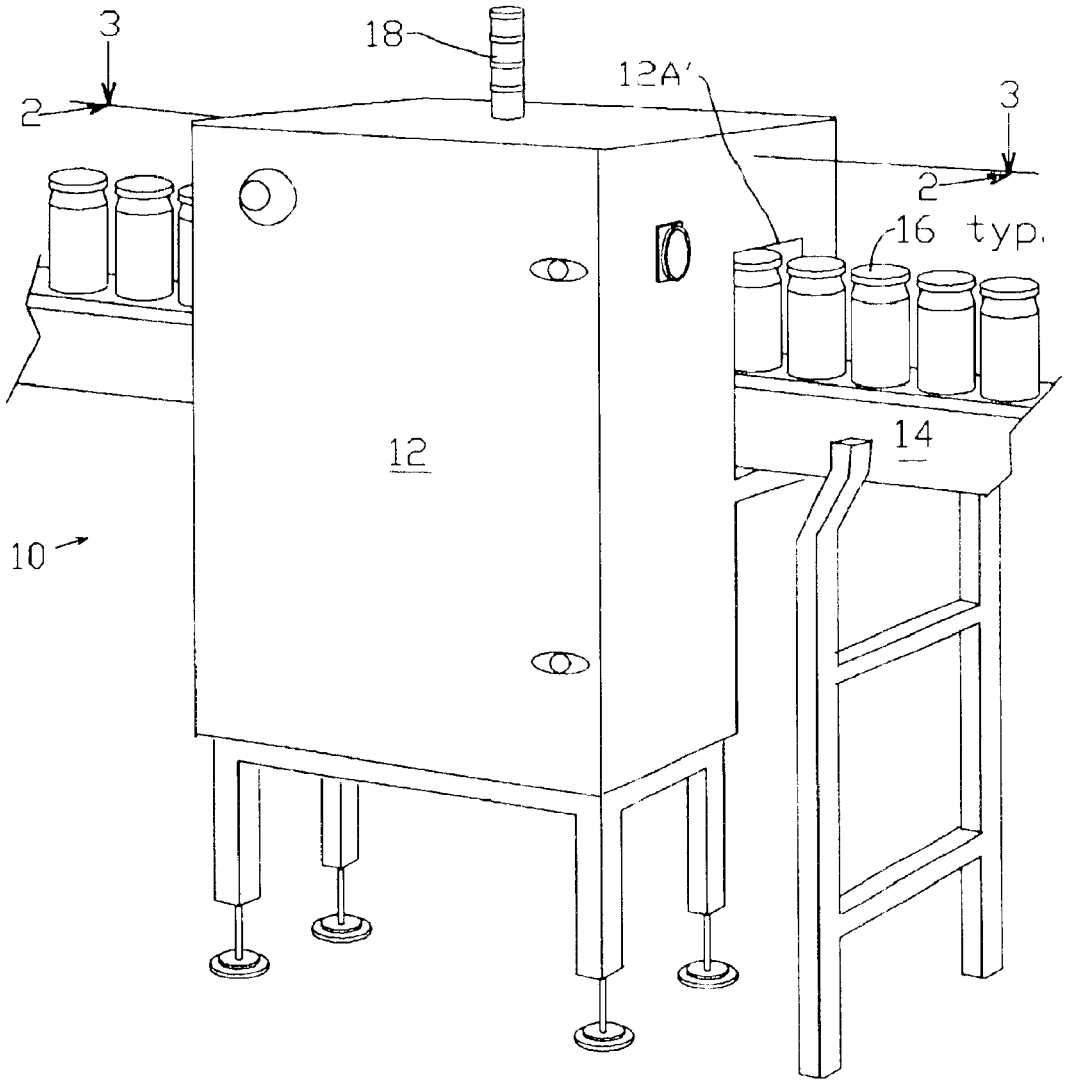
FIG. 1 is a perspective view of an x-ray inspection station of the present invention.

FIG. 1, a perspective view of an x-ray inspection station 10 of the present invention, showing the main enclosure 12 surrounding a conveyor 14 along which food/beverage containers 16 are moved from right to left into opening 12A' and through enclosure 12 for x-ray inspection. Movement of containers 16 along conveyor 14 and the activation of x-ray apparatus in enclosure 12 are controlled by a microprocessor and control console (not shown), with status indicated by a multi-colored light indicator 18.

Figure 2:
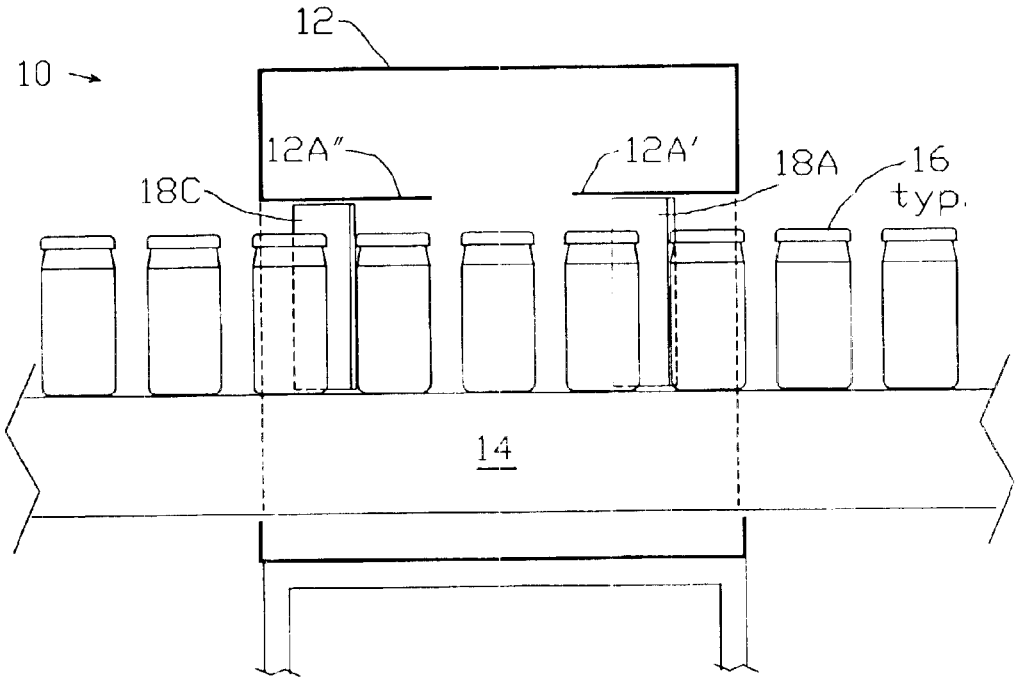
FIG. 2 is a cross-sectional elevational view taken through axis 2—2 of FIG. 1 indicating the locations of the swinging shield doors.

FIG. 2, a cross-sectional elevational view of inspection station 10 taken through axis 2—2 of FIG. 1, shows a normal close-spaced full load of containers 16 traveling from right to left along conveyor 14. Inside enclosure 12, are shown two swinging shield doors 18A and 18C, of a total of four, located as indicated in entry tunnel 12A' and exit tunnel 12A' respectively, against the sidewalls thereof.

Figure 3:
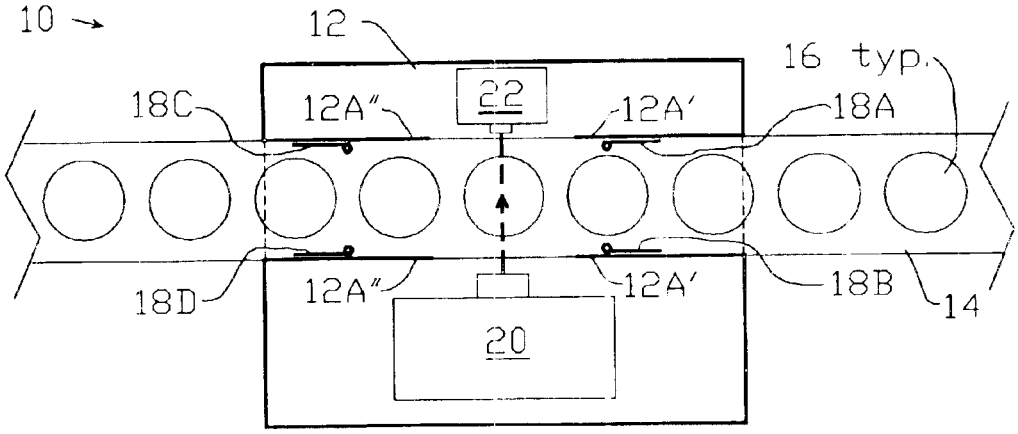
FIG. 3 is a cross-sectional plan view taken through axis 3—3 of FIG. 1, shown in a normal operating mode with the swinging shield doors held open while a full series of containers is moved along by the conveyor.

FIG. 3, a cross-sectional plan view of inspection station 10 taken through axis 3—3 of FIG. 1, shows four swinging shield doors, 18A and 18B in entry tunnel 12A' also 18C and 18D in exit tunnel 12A'; the four doors, all hinged at the right hand side, are shown in a normal operating mode with the doors held in the open position against the tunnel sidewalls so as to allow free passage of the containers 16 along conveyor 14. Doors 18A are made from high density x-ray shielding material.

Within enclosure 12, an x-ray generator 20 is directed through a central container under test, as indicated by the broken line and arrow, to a sensor 22. The inspection station control system sets the speed of the conveyor 14, controls activation of x-ray generator 20 and evaluates the data from sensor 22. Optionally conveyer 14 may be made to run continuously at a designated speed, or to stop temporarily for each x-ray test.

Figure 4:
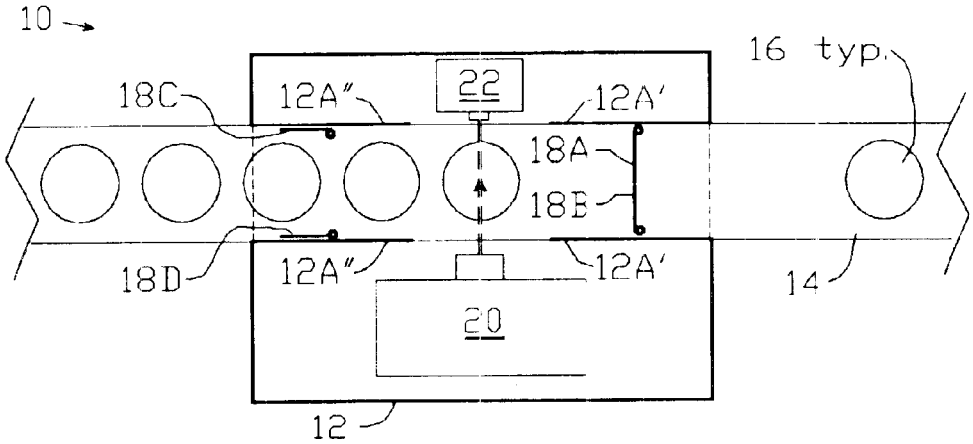
FIG. 4 depicts the condition as in FIG. 3, but with a is a cross-sectional plan view taken through axis 3—3 of FIG. 1, showing the pair of swinging shield doors in the entry tunnel closed due to a gap in the series of containers having reached the entry region.

FIG. 4 is a cross-sectional plan view taken through axis 3—3 of FIG. 1, similar to FIG. 3 except that, in containers 16 on the conveyor 14 there is a gap of three missing containers in the entry region. This gap has been sensed by an infra-red sensing system in the control system, which accordingly actuated swinging shield doors 18A and 18B to rotate to the closed position as shown, thus preventing escape of stray x-rays in the absence of containers in entry tunnel 12A'.

Figure 5:
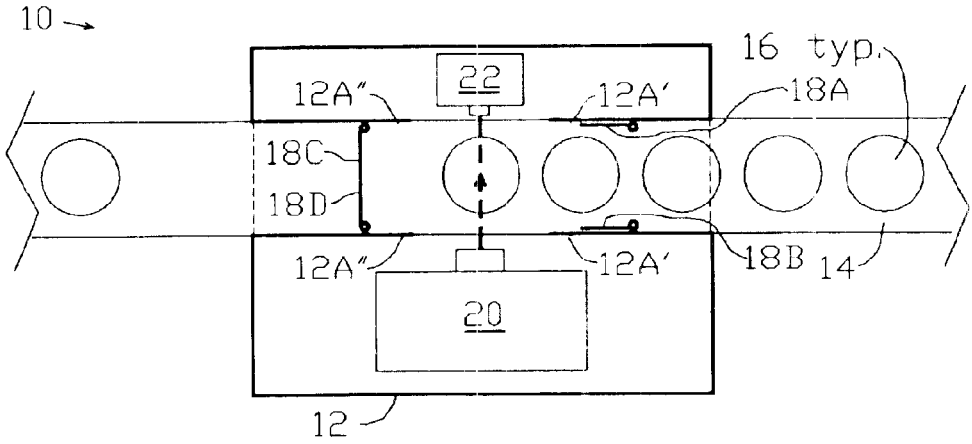
FIG. 5 depicts the subject matter of FIG. 4 at a sequential point in time with the pair of swinging shield doors in the exit tunnel closed due to the gap having reached the exit region.

FIG. 5 depicts, as sequential to FIG. 4, the series of containers 16 having been advanced along by the conveyor 14 to where the gap is now sensed to be in the exit region and the next container 16 is in place to be tested; the pair of swinging shield doors 18C and 18D in the exit tunnel 12A' are seen to have closed by the control system to prevent escape of stray x-rays in the absence of containers in exit tunnel 12A'.

Figure 6:
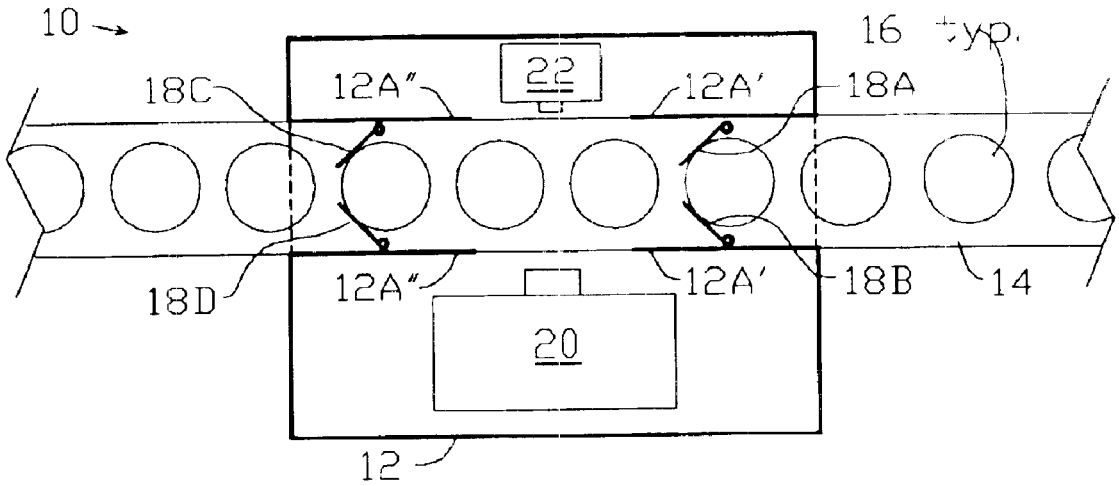
FIG. 6 depicts the subject matter of FIGS. 3–5, showing both pairs of swinging shield doors operating in a passive fail-safe mode.

FIG. 6 depicts the subject matter of FIGS. 3–5, showing both pairs of swinging shield doors 18A–D operating in a passive fail-safe mode: in the event of a failure of door-motivating power, all four doors 18A–D are made and arranged to automatically override the actuators and close by passive default, e.g. light spring loading, becoming forced open as required by direct contact from the containers 16 as they move along the conveyor 14.

Figure 7:
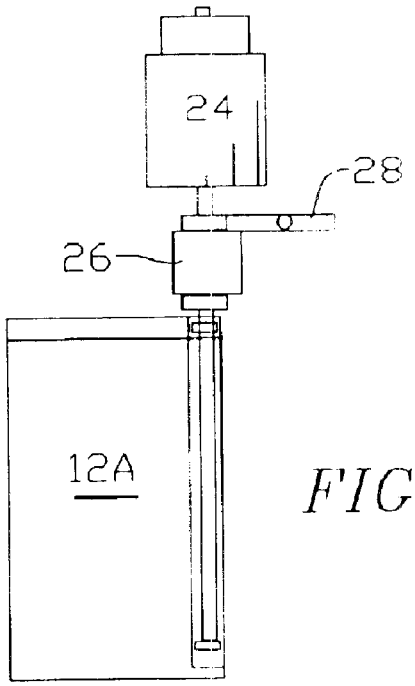
FIG. 7 is an elevational view of a swinging shielded door assembly including a pneumatic actuator and release clutch.

FIG. 7 is an elevational view of a typical unit (one of four) in the shielded door system. A pneumatic actuator 24 that operates from compressed air, is located above the hinge side of a typical door 18 and its drive shaft is coupled to door 18 via a coaxial release clutch unit 26 which, in the event of a failure of actuator 24 or its source of motivating power, allows the door 18A to override the disabled actuator 24 and to close passively as described above in connection with FIG. 6.

As an alternative to pneumatic operation, doors 18A–D could be made to operate from other sources of power such as electric or hydraulic.

The invention can be practiced with the doors located elsewhere within the corresponding tunnel. The four walls 12A of the two tunnels may be made as separate adjustable baffles, each with a door 18 attached.

The x-ray shielding material can be selected from a group of high molecular weight materials suited to x-ray shielding, including lead, and utilized in a designated thickness.

Typically the door actuators are made to have a door swing range of 90 degrees from open to closed, and are installed with the assumptions that the conveyor movement is in a particular direction through the enclosure. To make the station reversible with regard to the conveyor direction the actuators could be made to have a total swing range of 180 degrees, with either 90 degree range selectable. Otherwise the door mounting arrangements could be made reversible to enable the doors to swing open in the opposite direction.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. An x-ray radiation suppression system relating to x-ray inspection of food and beverage products in containers moving along a conveyor and proceeding through an inspection station enclosure configured with an entry opening and an exit opening, the radiation suppression system comprising:

the inspection station enclosure being made from x-ray shielding material:

an entry tunnel of x-ray shielding material extending inwardly in the enclosure from the entry opening;

an exit tunnel of x-ray shielding material extending inwardly in the enclosure from the exit opening;

four shield doors made from x-ray shielding material, and arranged to have a closed position that effectively suppresses harmful x-ray radiation outside the enclosure, and an open position that permits free movement of the containers along the conveyor; two of the doors being located within the entry tunnel on opposite sides thereof, and the other two doors being located within the exit tunnel on opposite sides thereof, each door being hinged along a vertical edge at a hinge axis located near a tunnel wall such that in the open position each door is disposed near and substantially parallel to the tunnel wall and in the closed position each door is disposed substantially perpendicular to the tunnel wall, the doors in each opposite pair extending to each other so as to substantially block x-ray radiation from the tunnels, and door actuating means for repositioning the shield doors between the closed and the open position.

2. The x-ray radiation suppression system as defined in claim 1 wherein the door actuating means for each door comprises a rotary type pneumatic actuator, located above the door and coupled operationally thereto, made and arranged to open and close the door in response to a command signal.

3. The x-ray radiation suppression system as defined in claim 2 further comprising for each door, a slip clutch coupling the actuator operationally to the corresponding door, made and arranged to allow the actuator to open and close the door, and further to allow the door to be opened from force applied by a container moving along the conveyor.

4. The x-ray radiation suppression system as defined in claim 3 further comprising for each door a passive force means made and arranged to urge the door to the closed position independently of the actuators, so as to preserve x-ray radiation leakage from the corresponding tunnel in the event of a lack of containers within the corresponding tunnel and failure of the door actuator for any reason.

* * * * *